US011175028B1

(12) United States Patent
Chen

(10) Patent No.: US 11,175,028 B1
(45) Date of Patent: Nov. 16, 2021

(54) COMBINATION LAMP SUPPORT STABILIZER AND ELECTRICAL CONNECTOR

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/155,179

(22) Filed: Jan. 22, 2021

(51) Int. Cl.

| | |
|---|---|
| ***F21V 23/06*** | (2006.01) |
| ***F21V 21/002*** | (2006.01) |
| ***F21V 21/08*** | (2006.01) |
| ***H01R 33/92*** | (2006.01) |
| ***H01R 13/73*** | (2006.01) |
| ***G09F 13/02*** | (2006.01) |
| ***H01R 33/06*** | (2006.01) |
| ***F21Y 115/10*** | (2016.01) |

(52) U.S. Cl.
CPC ..... *F21V 23/06* (2013.01); *F21V 21/002* (2013.01); *F21V 21/0808* (2013.01); *G09F 13/02* (2013.01); *H01R 13/73* (2013.01); *H01R 33/06* (2013.01); *H01R 33/92* (2013.01); *F21Y 2115/10* (2016.08)

(58) Field of Classification Search
CPC .... F21V 23/06; F21V 21/0808; F21V 21/002; F21V 19/0025; H01R 33/06; H01R 33/92; H01R 13/73; G09F 13/02; F21Y 2115/10; F21W 2131/405; F21S 4/20; F21S 4/28
See application file for complete search history.

(56) References Cited

U.S. PATENT DOCUMENTS

| | | | | |
|---|---|---|---|---|
| 9,620,889 | B1 * | 4/2017 | Buck | H01R 9/223 |
| 10,107,481 | B1 * | 10/2018 | Chen | F21S 8/08 |
| 10,309,634 | B2 * | 6/2019 | Webb | H01R 13/5219 |
| 2011/0005907 | A1 * | 1/2011 | Serak | H01R 31/02 200/51.05 |
| 2015/0241035 | A1 * | 8/2015 | Dankelmann | F21V 23/06 362/219 |

* cited by examiner

*Primary Examiner* — Peggy A Neils
(74) *Attorney, Agent, or Firm* — Stuart M. Goldstein

(57) ABSTRACT

A stabilizer and electrical connector maintains a stable and secure electrical connection between an electric lighting module lamp support and a signage frame. The connector is an integral, unitary body having a plate shaped base section with dual lateral tension clips extending down from the base section and an adhesive member which is attached to the bottom surface of the base section. The connector uses a "stick and hold" method to lock itself to the face of a signage frame. The integral body also has a columnar support section having a through channel extending up from the base section to accept an electric lighting module lamp support. An electrical connector section having a front facing cavity containing front facing electrical plugs and at least one lateral cavity containing laterally facing electric plugs also forms a part of the connector's integral body.

6 Claims, 4 Drawing Sheets

COMBINATION LAMP SUPPORT STABILIZER AND ELECTRICAL CONNECTOR

BACKGROUND OF THE INVENTION

Light emitting diodes (LED) are commonly used for signage on stores, restaurants, bars, billboards, and other structures where there is a need to display information, to provide safety lighting, or to identify or accentuate the appearance of a building. Such LEDs are routinely mounted on lamp supports, some of which are secured to signage frames, to specifically direct the lighting to illuminate signage. However, natural environmental conditions such as high winds, storms, earthquakes and tremors, and man-made events such as impacts and damage to signage or sign supports resulting from vehicle collisions, can result in total displacement of LED lighting or unwanted light angle tilt. Light angle tilt is the correct position a light beam is directed to optimally illuminate the face of a sign. Displacement of the light angle tilt could result in the sign being partially hidden or not seen at all. Severe displacement could also result in disconnection from the electrical power source and disruption of the LED lighting.

SUMMARY OF THE INVENTION

It is thus the object of the present invention to provide a lamp support stabilizer and electrical connector which is fitted on an electrical LED lighting module lamp support and a signage frame in order to prevent displacement of the lamp support and hence the LED module lighting, or to prevent a tilt in the lighting angle and, additionally, to maintain a fixed electrical connection with the electrical power source.

These and other objects are accomplished by the present invention, a combination stabilizer and electric connector for maintaining a stabilized and secure electrical connection between an electric lighting module lamp support and a signage frame. The connector is an integral, unitary body having a plate shaped base section with dual lateral tension clips extending down from the base section and an adhesive member which is attached to the bottom surface of the base section. The connector uses a "stick and hold" method to lock itself to the face of an existing signage frame. The integral body of the connector also has a columnar support section having a through channel extending up from the top surface of the base section to accept an electric lighting module lamp support. An electrical connector section having a front facing cavity containing front facing electrical plugs and at least one lateral cavity containing laterally facing electric plugs also forms a part of the connector's integral body.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 3:
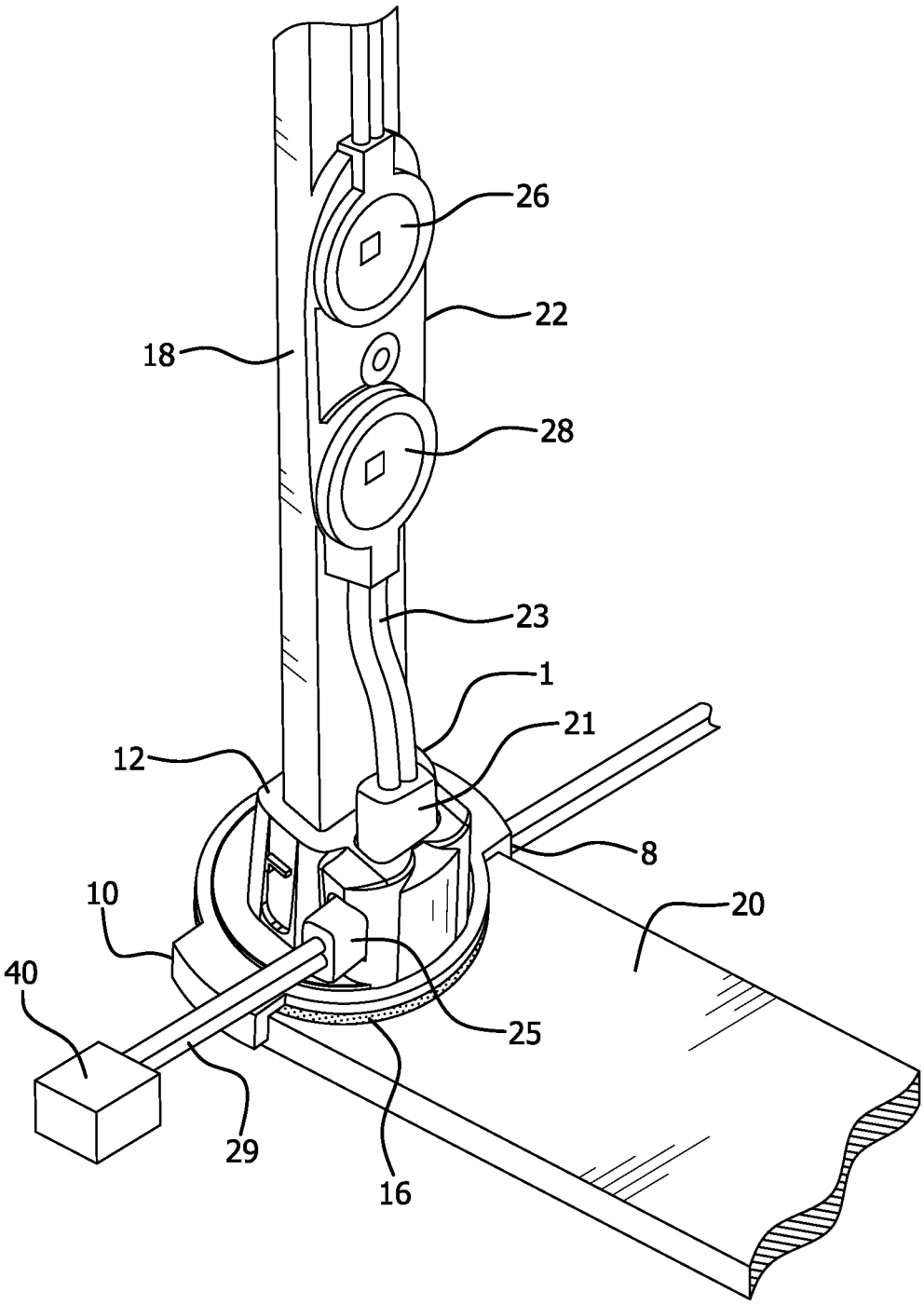
FIG. 3 shows a single lamp support stabilizer and electrical connector of the present invention used with a lamp support and a signage frame.

Lamp support stabilizer and electrical connector 1 of the present invention is an integral body comprising circular shaped plate base section 2 having top surface 4 and bottom surface 6. Dual lateral locking clip members 8 and 10 extend downwardly from opposite sides of base section 2 and rectangular shaped columnar support section 12 extends upwardly from top surface 4 of the base section. Support section 12 has lamp support through channel 14 for receiving, supporting, and stabilizing an LED lamp support. Adhesive member 16 is designed to be attached to bottom surface 6 of base section 2 of connector 1. As seen in FIG. 3, LED lamp support 18, having been inserted into columnar support section 12 of connector 1, is then positioned on signage frame 20 with its clip members 8 and 10 located along the sides of and tightly hugging the signage frame.

Electrical connector section 3 of stabilizer and electrical connector 1 is positioned adjacent to column support section 12 as part of the integral body of connector 1. Electrical connector section 3 has front facing cavity 5 containing front facing electric plugs 7. Cavity 5 with plugs 7 is configured as an HO electrical socket for receiving female electrical outlet member 21. Member 21 is connected to electrical wiring 23 which leads to LED lighting module 22 having lamps 26 and 28 which are mounted on lamp support 18.

Connector section 3 also has lateral facing cavities 9 and 11 with lateral facing electrical plugs 13 and 15 for receiving female electrical outlet member 25. These electric plugs are electrically interconnected with plugs 7 to complete an electric circuit with female outlet member 25, electrically connected to electric wiring 29 leading to electrical power source 40, thereby illuminating lamps 26 and 28.

Figure 4:
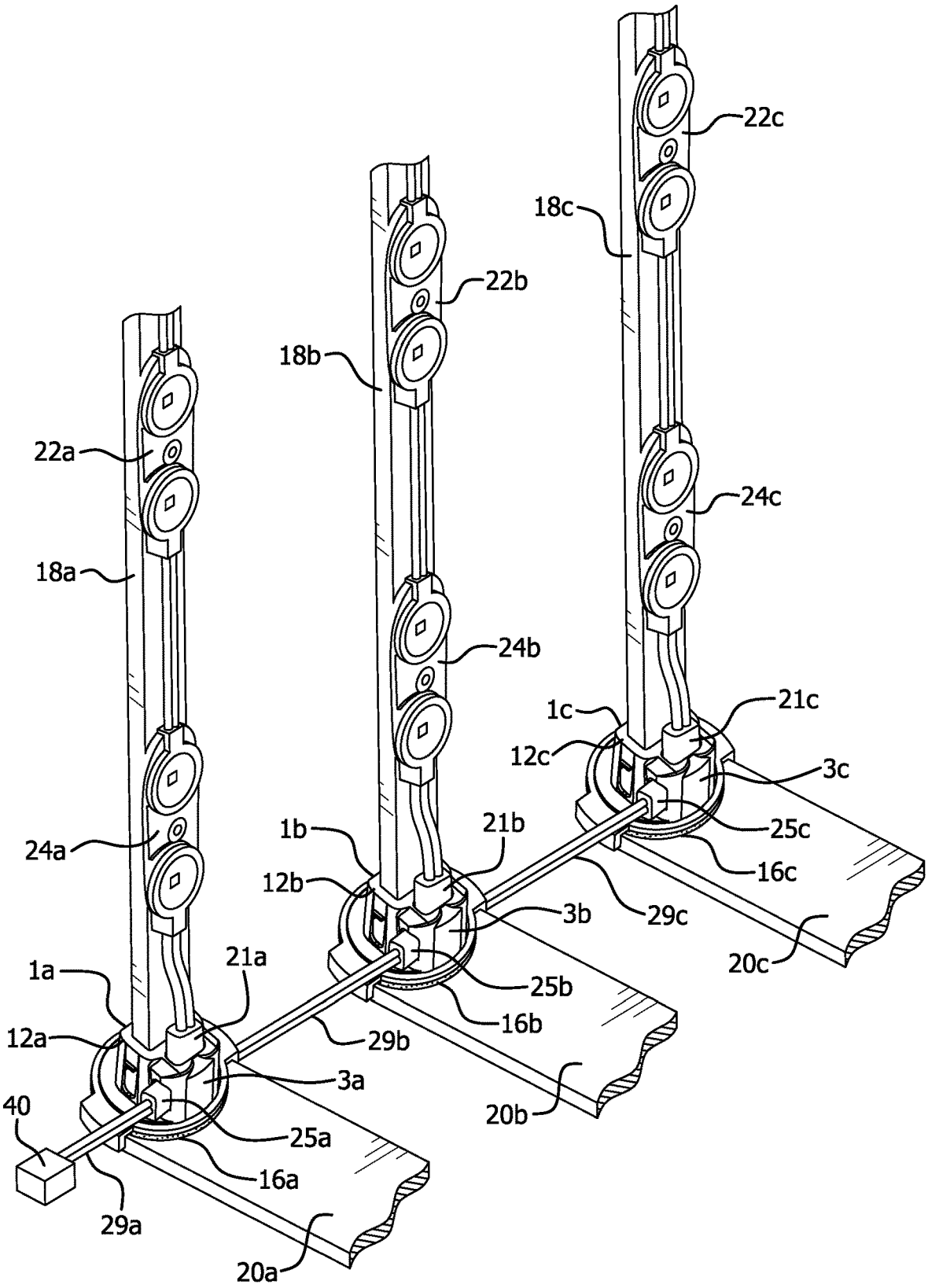
FIG. 4 illustrates the use of lamp support stabilizer and electrical connectors of the present invention in an LED lighting signage system.

Thus, lamp support stabilizer and electrical connector 1 can be used to both stabilize and electrically power an LED lighting system, as illustrated in FIG. 4. Initially, connectors 1*a*, 1*b*, and 1*c* fixedly support and stabilize LED lamp supports 18*a*, 18*b*, and 18*c*, on their respective signage frames 20*a*, 20*b*, and 20*c* by insertion into support sections 12*a*, 12*b*, and 12*c* of the connectors.

Figure 1:
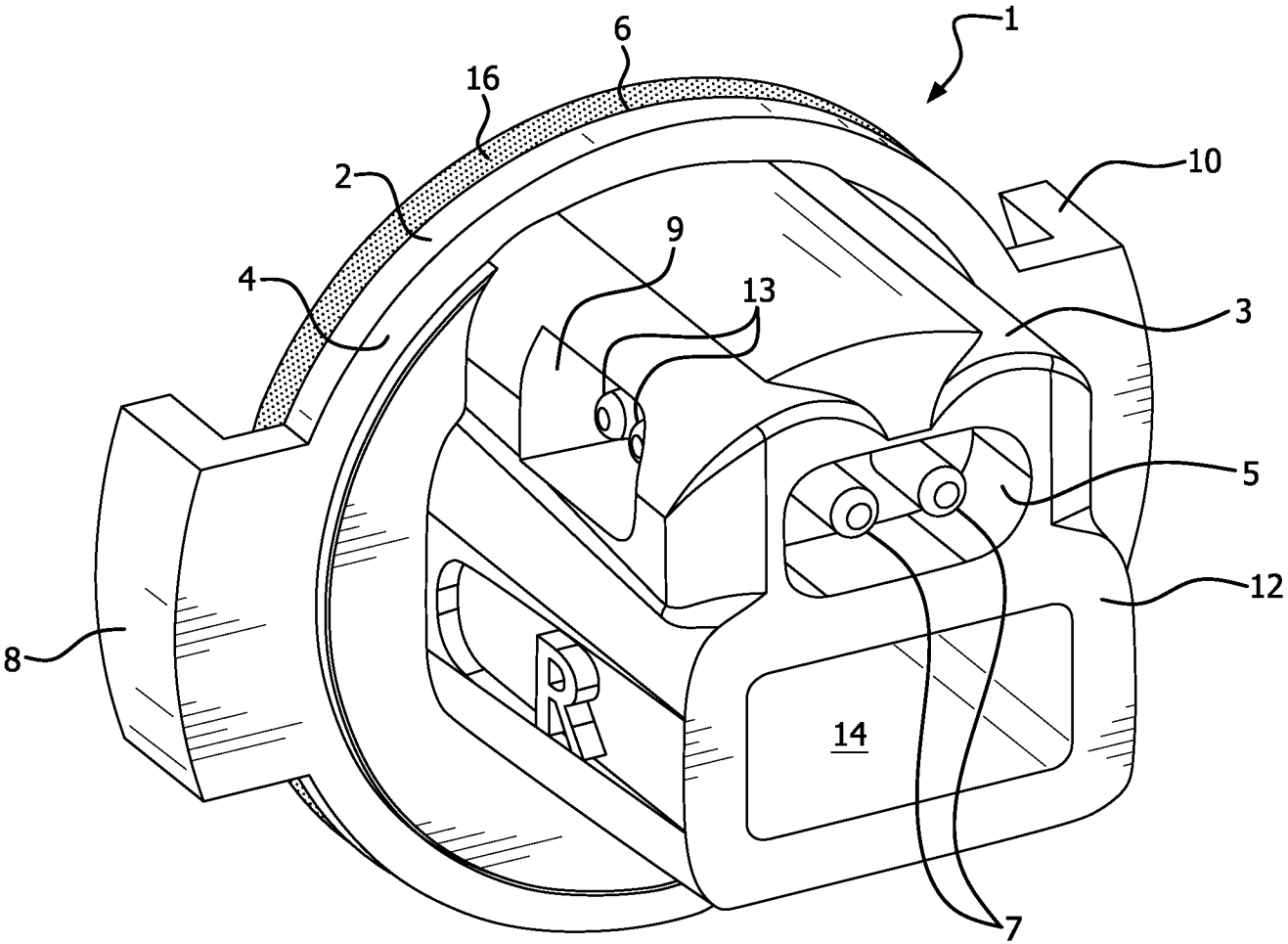
FIG. 1 is a front side, right perspective view of the lamp support stabilizer and electrical connector of the present invention.
Figure 2:
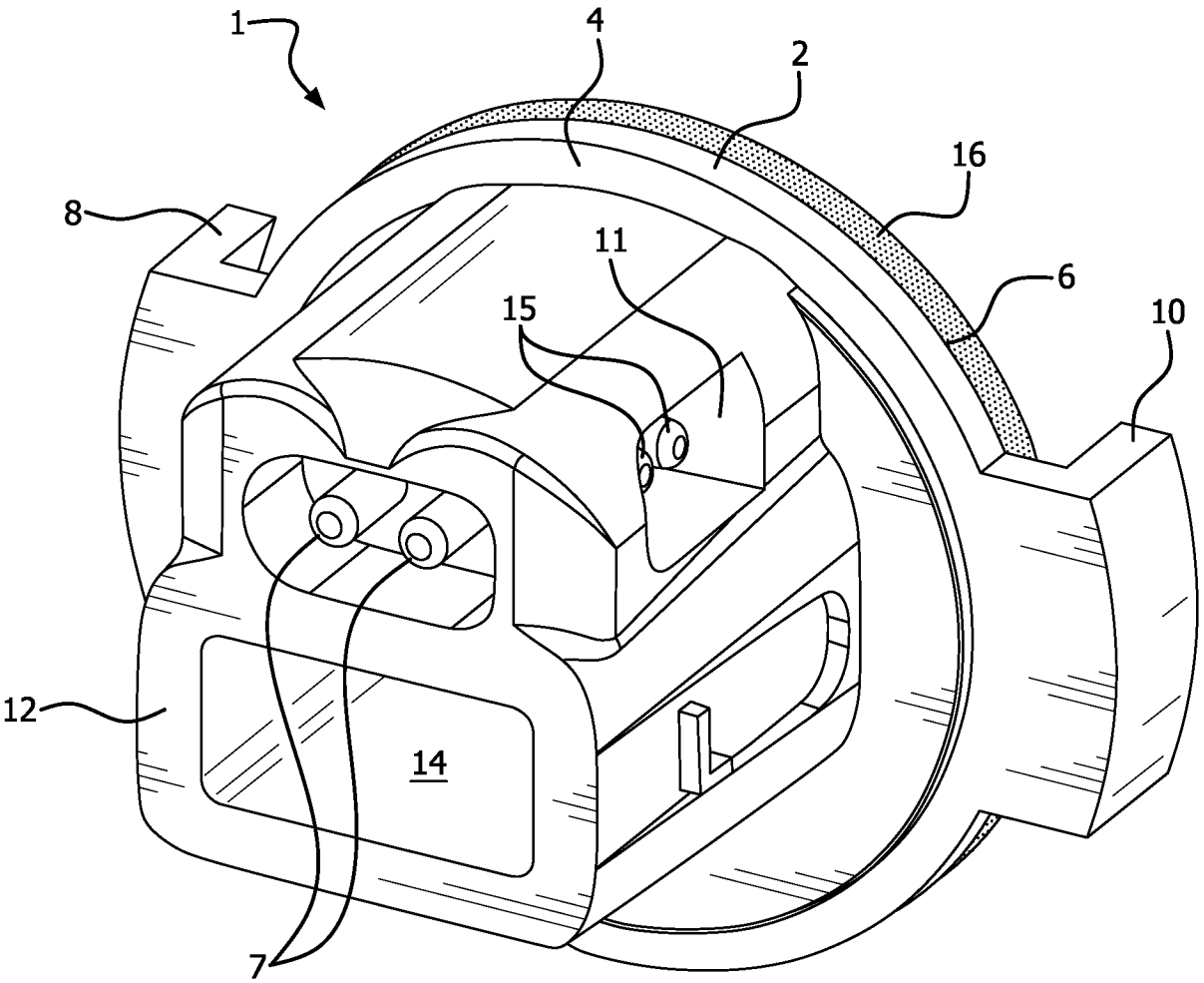
FIG. 2 is the opposite front side, left perspective view of the lamp support stabilizer and electrical connector of the present invention.

Connector 1 also serves to provide an electric pathway to illuminate LED lighting modules 22*a*, 24*a*, 22*b*, 24*b*, 22*c* and 24*c* via power source 40. The power source transmits electricity via wiring 29*a*, 29*b*, and 29*c* to electrical connector sections 3*a*, 3*b*, and 3*c* of connectors 1*a*, 1*b*, and 1*c* by means of female electrical outlet members 25*a*, 25*b*, and 25*c* which are plugged into electric plugs 13 and 15 in connector section 3 (as seen in the exemplar connector illustrated in FIGS. 1 and 2). The electricity from power source 40 is then in turn transmitted from female electrical outlet members 21*a*, 21*b*, and 21*c* which are plugged into electric plugs 7 in connector section 3 (again as seen in FIGS. 1 and 2) to illuminate LED light modules 22*a*, 24*a*, 22*b*, 24*b*, 22*c* and 24*c*.

In this manner, the lamp support stabilizer and electrical connector 1 of the present invention offers a simple, yet effective means of providing a secure, immoveable and stable connection between signage frames and LED or like lamp supports, while also providing a compact and efficient means of transmitting electricity to LED lighting modules mounted on the lamp support. The present invention also necessitates the use of only a single end cap to be locked into place at the opposite end of the lamp support; and it allows the lamp support to be positioned vertically, horizontally, or in any regular position by use of a single, economically manufactured component.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A stabilizer and electrical connector for maintaining a stable and secure electrical connection between an electric lighting module lamp support and a signage frame, said connector comprising:

an integral unitary body having:

a plate-shaped base section;

dual lateral locking clip members extending downwardly from opposite sides of the base section;

a columnar support section extending upwardly from the base section, said columnar section having a through channel sized to accept a lamp support; and an electrical connector section having a front facing cavity containing electrical plugs and at least one lateral cavity containing electrical plugs.

2. The stabilizer and electrical connector as in claim 1 wherein the base section of the unitary body has a bottom surface and an adhesive member secured to said bottom surface, wherein the adhesive member and the base section are configured to be positioned on a signage frame with the locking clip members tightly hugging the sides of said signage frame, and wherein an electric lighting module lamp support is positioned within the channel of the columnar support section thereby providing a secure immoveable and stable connection between the lamp support and the signage frame with the electrical section establishing an electrical connection between the connector and at least one electric lighting module.

3. The stabilizer and electrical connector as in claim 1 wherein the base section is configured to be positioned on a signage frame with the locking clip members tightly hugging the sides of said signage frame, and wherein an electric lighting module lamp support is positioned within the channel of the columnar support section thereby providing a secure immoveable and stable connection between the lamp support and the signage frame with the electrical section establishing an electrical connection between the connector and at least one electric lighting module.

4. A system for maintaining a stable and secure electrical connection between a lamp support for electric lighting modules and signage frames, said system comprising:

a signage frame rigidly supporting and maintaining a lamp support having at least one electric lighting module;

a stabilizer and electrical connector comprising an integral unitary body having a plate-shaped base section, dual lateral locking clip members extending downwardly from opposite sides of the base section, a columnar support section extending upwardly from the base section, said columnar section having a through channel, and an electrical section having a front facing cavity containing front facing electrical plugs and at least one lateral cavity containing laterally extending electrical plugs, wherein the base section of the connector is positioned on the signage frame with the locking clip members tightly hugging the sides of said signage frame, and wherein the lamp support is positioned within the channel of the columnar support section thereby providing a secure, immoveable, stable connection between the lamp support and the signage frame with the electrical section establishing an electrical connection between the connector and the at least one electric lighting module.

5. The system as in claim 4 further comprising an adhesive member positioned between the base section and the signage frame.

6. The system as in claim 4 comprising a plurality of electric lighting module lamp supports supporting at least one electric lighting module, each lamp support being supported and maintained on a signage frame by a single stabilizer and electrical connector and being electrically connected to a power source by said single connector.

* * * * *